US006217427B1

(12) United States Patent
Case et al.

(10) Patent No.: US 6,217,427 B1
(45) Date of Patent: Apr. 17, 2001

(54) MOBIUS STRIP BELT FOR LINEAR CMP TOOLS

(75) Inventors: Christopher J. Case; Carlye B. Case, both of New Providence, NJ (US)

(73) Assignee: Agere Systems Inc., Murray Hill, NJ (US)

( * ) Notice: Subject to any disclaimer, the term of this patent is extended or adjusted under 35 U.S.C. 154(b) by 0 days.

(21) Appl. No.: 09/286,430

(22) Filed: Apr. 6, 1999

(51) Int. Cl.[7] ..... B24B 21/00
(52) U.S. Cl. ..... 451/296; 451/300
(58) Field of Search ..... 451/41, 60, 59, 451/296, 299, 300, 303, 304, 305, 306, 307

(56) References Cited

U.S. PATENT DOCUMENTS 5,361,546 * 11/1994 Jonsson ..... 451/296
5,716,264 * 2/1998 Kimura et al. ..... 451/60
5,722,877 * 3/1998 Meyer ..... 451/303
5,727,989 * 3/1998 Ohno et al. ..... 451/60
5,755,614 * 5/1998 Adams et al. ..... 451/60
5,762,536 * 6/1998 Pant et al. ..... 451/296
5,775,980 * 7/1998 Sasaki et al. ..... 451/286
5,791,969 * 8/1998 Lund ..... 451/296
5,928,068 * 7/1999 Matsuda et al. ..... 451/296

FOREIGN PATENT DOCUMENTS

7230973 * 7/1995 (JP) ..... 451/296

* cited by examiner

*Primary Examiner*—Derris H. Banks

(57) ABSTRACT

A tool for the linear polishing of substrates includes an endless belt of continuous strength wrapped substantially as a helix of predetermined length and width with a 180 degree twist along the length to increase by a factor of 2× the time interval between which belt changes need to be made because of wear-and-tear, significantly reducing the costs associated with the polishing because of reduced down time. In a preferred embodiment for the chemical-mechanical polishing of silicon wafer substrates used in fabricating integrated circuits, the endless belt is constructed as a Mobius strip of a rubberized, urethane composition to be flexible, but yet strong enough to withstand the applied pressure between the polishing belt and the substrate.

14 Claims, 1 Drawing Sheet

MOBIUS STRIP BELT FOR LINEAR CMP TOOLS

BACKGROUND OF THE INVENTION

1. Field of the Invention

This invention relates to the chemical-mechanical-polishing (CMP) of flat surfaces and, more particularly, to such polishing of silicon wafers to achieve global planarization in the manufacture of integrated circuits.

2. Description of the Related Art

As is well known and understood, the traditional technique for polishing silicon wafers flat across the entire surface is through the use of circular motion in which a polishing pad and the wafer below it rotate together. As is also known to those skilled in the art, whether the polishing is done purely mechanically, or combined with a liquid affording a chemical function, the typical pad life (because of wear and tear) extends from about 100 wafers to about 500 wafers. Independent of the manner by which the deterioration is measured or determined, there then follows a "down-time" for the changing of the pad, and for the conditioning of its replacement to bring it to the state at which the polish rate is constant. When considering the $40.00–$50.00 cost of each pad as used in polishing silicon wafers of some 8 inches in diameter—and the time spent in replacing and conditioning the pad—calculations have shown that these rotatable pads account for anywhere between 15 and 30 percent of the cost associated with the CMP tool. Because of the necessity to replace, and then condition these pads, a manner of extending the interval between their exchange would be highly desirable.

SUMMARY OF THE INVENTION

As will become clear from the following description, the present invention proceeds by the doing-away of the conventional circular platen, and replacing it, instead, with a linear pad to provide a CMP tool analogous to a belt sander. As will be understood, this follows from a recognition of the control that becomes afforded (in particular, with the linear implementation of the invention) when the speed of the belt left-and-right across the silicon wafer substrate is set so that the velocities and the velocity vectors stay constant. On the other hand, with the traditional circular, rotary motion between the substrate and the polishing pad, the wear which results tends to form a groove in the pad. This groove causes the relative velocities to vary, and the vectors on the surfaces to change, thereby producing a very complex dynamic process.

As will also become clear from the following description, the present invention goes beyond the mere substitution of a linear polishing of the silicon wafer substrate for the previously employed rotatable polishing—and, by the incorporation of a twist in the linear belt, to make it a Mobius strip utilizing both the front and back surfaces of the belt to increase its life. Such Mobius strips are generally defined as being a surface with only one side and one edge, made by placing a twist of 180 degrees in the strip whose ends are secured together. In accordance with the present invention, such an endless belt of continuous strength is employed, wrapped about a pair of oppositely positioned tensioning rollers, with the 180 degree twist substantially giving the belt the appearance of a helix of predetermined length and width. As will be understood, utilizing the belt in this manner as the polishing pad thus increases by a factor of 2×, the interval before the pad must be changed due to its deterioration. This increase in lifetime significantly decreases the cost associated with the CMP tool because of the reduced down time of the polishing pad.

As will additionally become clear from the description that follows, a linear polishing tool constructed in this manner, and in further accordance with the invention, also can be provided with an adhesive surface on the tensioning rollers for the capture of particles that are removed from the substrate during the polishing process. Alternative to this, and similarly in accordance with the invention, a vacuum system arrangement can be included for the capturing of these removed particles, or a brush-cleaner configuration can be employed for their capture.

Further embodying the invention to be described is the applicability of the linear tool to be used either with slurry, or slurryless systems for providing both the abrasive and chemical components which typify traditional rotatable CMP tools —with the slurryless system, however, being the preferable one due to the resulting absence of any slurry build up on the tensioning rollers, and without the loss of any slurry as the linear belt makes its way through the linear polishing tool.

Particularly useful in the chemical-mechanical polishing of silicon wafer substrates, moreover, the invention will be understood to find usefulness in any type of linear polishing operation, and not strictly to silicon wafer polishing. In such configuration, the linear polishing tool could be operative with apparatus for measuring the removal rate from a substrate during the polishing process, as an aid to indicate the time at which even the linear polishing pad should be replaced and conditioned. Operative with either the abrasive alone, or in a chemical or any other type of liquid solution, the advantages which follow from the invention will readily become apparent.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
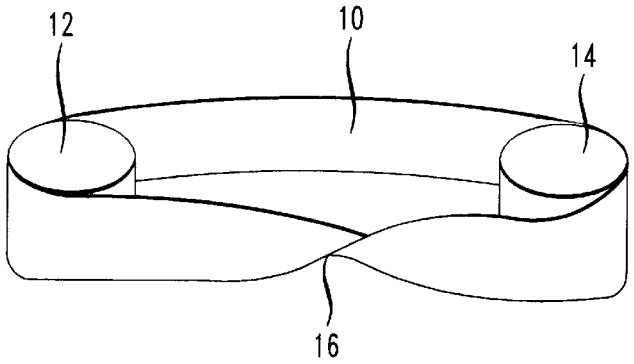
FIG. 1 is a perspective view of an endless belt of Mobius strip construction about a pair of tensioning rollers, helpful in an understanding of the present invention.

In FIG. 1, an endless belt 10 is shown, suitable for being drawn in either direction, left-or-right during use, about a pair of tensioning rollers 12, 14. As shown, the belt 10 is of a spliceless, Mobius strip construction having a 180 degree twist 16 along its length, substantially giving the appearance of a helix of predetermined length and width. As will be understood, such belt 10 provides essentially one spliceless continuous polishing surface of twice the predetermined length of the belt during its rotation about the tensioning rollers 12, 14.

Figure 2:
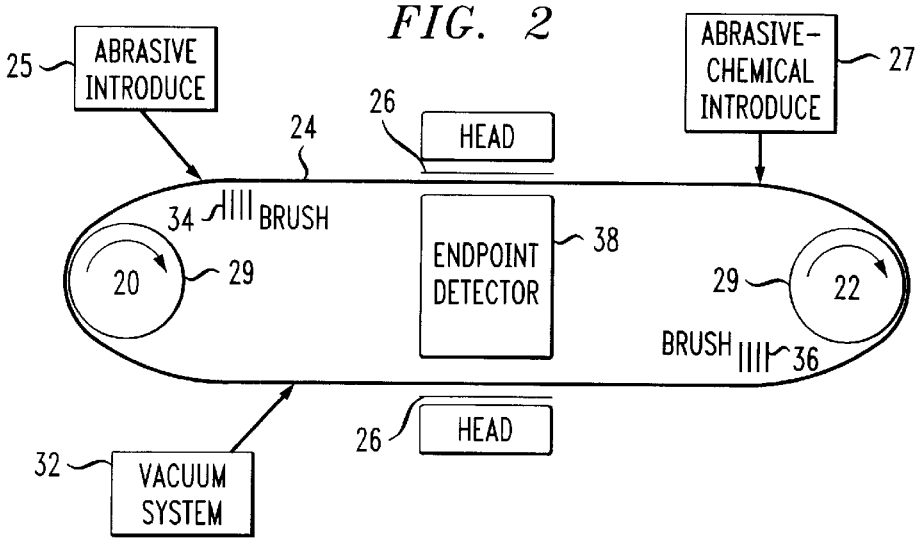
FIG. 2 schematically shows a linear tool illustrating the chemical-mechanical-polishing of a silicon wafer substrate.

In the linear polishing tool of FIG. 2, the oppositely positioned tensioning rollers are shown as 20, 22, about which a linear belt 24 is wound in appearance as a conventional belt sander. Dispenser 25 is illustratively shown for introducing an abrasive, alone or in a liquid solution, onto the linear belt 24 for the mechanical polishing of a substrate 26, while dispenser 27 is shown for the alternative introducing of an abrasive in a chemical solution to obtain a chemical-mechanical polishing of the substrate 26. Introduced as part of a slurry system, or as part of a slurryless system, the abraders wear the substrate 26—and an adhesive surface 29 could be incorporated about the tensioning rollers 20, 22 for capturing any of the particles removed from the substrate during the linear polishing process. Alternatively, and in any known manner, a vacuum system 32 could be employed to capture any of the particles removed as a result of the polishing step. Reference numerals 34, 36, on the other hand, depict yet another alternative for capturing these removed particles, as employing a brush cleaner arrangement for scraping the particles from the belt 24 for retrieval. Any appropriate detector 38 could be employed for measuring the rate of removal of the substrate particles, i.e., the deterioration of the belt 24 during use, to indicate at what point the polishing process should be halted, for the belt to be replaced. Where the substrate 26 is a silicon wafer, the belt 24 may be composed of a material such as urethane. In this respect, the polishing belt 24 will be understood to be composed with a degree of flexibility, yet strong enough to withstand the types of pressures that would exist between the belt 24 and the substrate 26.

While the linear belt of FIG. 2 represents an improvement over the typical rotatable CMP tool which characterizes the prior art, combining the linear tool of FIG. 2 with the Mobius strip belt of FIG. 1 represents a further improvement, in accordance with the teachings of the present invention.

Figure 3:
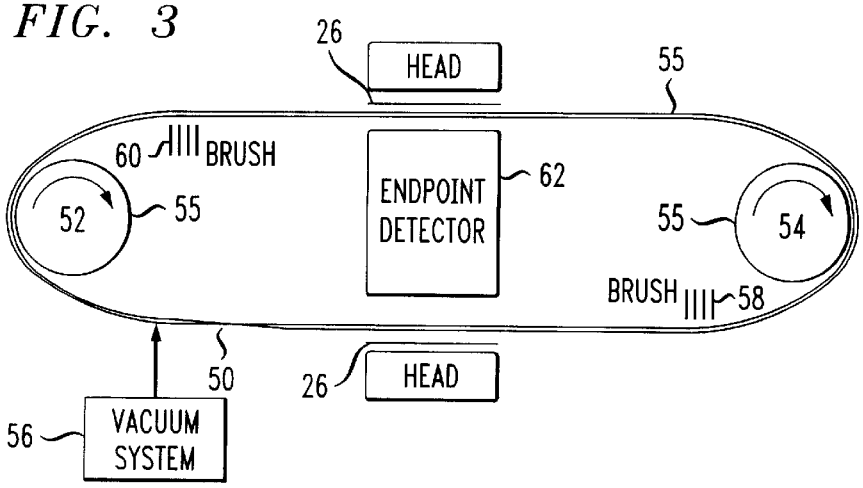
FIG. 3 schematically depicts a linear polishing tool embodying the Mobius strip construction in accordance with the teachings of the invention.

As thus shown in FIG. 3, the linear belt 24 of FIG. 2 is replaced by the Mobius strip of continuous strength of FIG. 1, with the twist being identified by the reference numeral 50. As with the arrangement of FIG. 2, either a slurry system (where the abraders are part of the chemical solution), or a slurryless system (where the abrasive is embedded in the belt or the belt has a textured surface) is utilized. As with the construction of FIG. 2, additionally, either an adhesive surface 55 could be employed with the tensioning rollers 52, 54, or a vacuum system arrangement 56, or a brush cleaning construction 58, 60 to scrape away the particles removed during the polishing process. A light, or other end point detector 62 could similarly be employed to determine the wear-and-tear on the Mobius strip belt 55, for its later replacement and conditioning. However, as will be appreciated, the pad twist 50 in FIG. 3 serves to increase the interval between changing the belt by a factor of 2×, reducing the maintenance time by one-half, and decreasing the conditioning time that much as well—thereby reducing the overall down time and cost associated with the CMP tool.

Additional reduction in the cost associated with the CMP tool follows with the invention as respects a further concurrent conditioning of the strip belt pad 55 during use. That is, by using a diamond stone (or a diamond-impregnated stone) which moves across the pad surface with or without any slurry being present, the pad 55 can be abraded during the flat portion of its erosion life, on both sides of the Mobius strip surface, due to the existence of the twist. Whether secured between the tensioning rollers, or under the belt 55, or in the vicinity of the wafer substrate, the conditioning can be done concurrently with the polishing to effectively double the amount of surface area that is being worked on at any one time. With this construction, the pad conditioner would be simple to integrate within the linear CMP tool, to enhance the effectiveness of conditioning the belt all the more.

A preferred way of implementing the invention follows the use of a rigid wafer carrier to provide the force between the polishing belt and the wafer itself. A system of controllable pistons under the belt is employed to push the belt into contact with the rigid wafer carrier. As will be understood, the use of this rigid carrier then allows the wafer to be held flat, such as with an electrostatic chuck or a vacuum chuck, in simplifying the dynamics of the operation. An array of pistons, furthermore, allows for adjustment of the removal rate throughout the wafer surface area, compensating for any non-uniform removal that might be present.

While there have been described what are considered to be preferred embodiments of the present invention, it will be readily appreciated by those skilled in the art that modifications can be made without departing from the scope of the teachings herein. Thus, whereas the invention has proceeded specifically on the manner in which CMP processing is effective for polishing silicon wafers to achieve global planarization in the fabrication of integrated circuits, the teachings of the invention will be seen to apply equally as well for any type of polishing operation, where a flat polishing would be desirable, and not just to the processing of silicon wafers. As the tool of the present invention offers the advantages described for any application where a linear motion is required in the polishing operation, resort should be had to the claims appended hereto for a true understanding of the scope of the advances set forth.

We claim:

1. A process for device fabrication comprising:

placing a substrate on a rigid carrier supporting the substrate substantially flat;

contacting a surface of the substrate to be polished with an endless belt of continuous strength wrapped about a pair of oppositely positioned tensioning rollers having a 180° twist along its length substantially as a helix of predetermined length and width to provide one spliceless continuous polishing surface of twice such predetermined length;

and moving said belt back-and-forth, linearly across said surface while in contact therewith.

2. The process of claim 1, also including the capturing of particles removed from said substrate during the linear moving of said belt across said surface.

3. The process of claim 1, also including the capturing of particles removed from said substrate during the linear moving of said belt across said surface by a vacuum system.

4. The process of claim 1, also including the capturing of particles removed from said substrate during the linear moving of said belt across said surface by a brush-cleaning system.

5. The process of claim 1, also including the dispensing of abrasive in liquid solution onto said belt while linearly moving said belt.

6. The process of claim 1, also including the dispensing of abrasive in chemical solution onto said belt while linearly moving said belt.

7. The process of claim 1, also including the dispensing of abrasive in liquid solution as a slurry onto said belt while linearly moving said belt.

8. The process of claim 1, also including the dispensing of abrasive in chemical solution as a slurry onto said belt while linearly moving said belt.

9. The process of claim 1, additionally including measuring the rate of particle removal from said substrate during the linear moving of said belt across said surface.

10. The process of claim 1, also including the capturing of particles removed from said substrate during the linear moving of said belt across said surface by an adhesion system incorporated about said tensioning rollers.

11. The process of claim 1, wherein said substrate placed on said rigid carrier is a silicon wafer to be polished.

12. The process of claim 1, wherein said surface of the substrate to be polished is contacted by an endless belt of a rubberized composition.

13. The process of claim 1, wherein said surface of the substrate to be polished is contacted by an endless belt of a urethane composition.

14. A process for device fabrication comprising:

placing a substrate on arigid carrier supporting the substrate substantially flat horizontally;

contacting a surface of the substrate to be polished with an endless belt of continuous strength wrapped about a pair of oppositely positioned tensioning rollers having a 180° twist along its length substantially as a helix of predetermined length and width to provide one spliceless continuous polishing surface of twice such predetermined length;

and moving said belt horizontally back-and-forth, linearly across said surface while in contact therewith.

* * * * *